US007059703B2

(12) United States Patent
Nakamura

(10) Patent No.: US 7,059,703 B2
(45) Date of Patent: Jun. 13, 2006

(54) INK JET RECORDING HEAD

(75) Inventor: Hirotake Nakamura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 147 days.

(21) Appl. No.: 10/157,195

(22) Filed: May 30, 2002

(65) Prior Publication Data

US 2002/0180832 A1 Dec. 5, 2002

(30) Foreign Application Priority Data

May 31, 2001 (JP) ..... 2001-164951
May 31, 2001 (JP) ..... 2001-164993
May 31, 2001 (JP) ..... 2001-165043

(51) Int. Cl.
*B41J 2/165* (2006.01)

(52) U.S. Cl. ..... 347/29; 347/50

(58) Field of Classification Search ..... 347/29, 347/34, 49, 50, 58, 68–72, 20, 37, 86–87
See application file for complete search history.

(56) References Cited

U.S. PATENT DOCUMENTS 4,940,998 A * 7/1990 Asakawa ..... 347/37
6,206,499 B1 * 3/2001 Iijima et al. ..... 347/20

FOREIGN PATENT DOCUMENTS

JP A-8-104005 4/1996
JP A-11-34342 * 2/1999
JP A-11-115187 4/1999
JP A-2000-15818 1/2000

* cited by examiner

*Primary Examiner*—Juanita D. Stephens
(74) *Attorney, Agent, or Firm*—Oliff & Berridge, PLC.

(57) ABSTRACT

An ink-jet recording head includes an actuator and a nozzle guide. The actuator ejects ink through a plurality of nozzle apertures. Wiring substrate is connected to the actuator at a connection portion and transmits drive signals to the actuator through the connection portion to drive the actuator to eject ink. The nozzle guide covers an outer periphery of the actuator while exposing the nozzle apertures. The nozzle guide also covers the connection portion between the actuator and the wiring substrate so as to be out of physical contact with ends of the connection portion. The nozzle guide includes a positioning portion used to position nozzle guide with respect to the actuator during assembly. A manifold is connected to the actuator and supplies the ink to the actuator. Seal agent fills areas between the actuator and the nozzle guide, between the wiring substrate and the actuator, between the nozzle guide and the actuator, and between the actuator and the manifold. The seal agent covers the connection portion between the actuator and the wiring substrate, supports the wiring substrate in between the nozzle guide and the manifold, and surrounds the entire outer peripheral surface of the actuator.

17 Claims, 10 Drawing Sheets

INK JET RECORDING HEAD

BACKGROUND OF THE INVENTION

1. Field of the Invention

The present invention relates to an ink jet recording head mounted on an ink jet printer, and more particularly to an ink jet recording head having a nozzle guide for protecting the head portion.

2. Description of the Related Art

Ink jet printers record images on recording media, such as paper sheets. A typical ink jet printer includes a platen, a carriage, and a recording head unit. The platen is provided for supplying the recording media. The carriage is oscillatingly moved in parallel with the platen across the surface of the recording medium. The recording head unit is mounted on the carriage and includes an ink jet recording head. While the carriage scans across the surface of the recording media, the ink jet recording head ejects ink based on image data to record an image on the recording medium.

There are many types of ink jet recording heads that can be mounted in ink jet printers. One type is called a piezoelectric type. A piezoelectric type ink jet recording head includes an ink chamber formed from a piezoelectric element. Ink is held in the ink chamber. A voltage is applied to the piezoelectric element so that the ink chamber deforms. This deformation reduces the volume in the ink chamber so that an ink droplet is ejected out from a nozzle connected to the ink chamber. Lead zirconate titanate, commonly known as PZT, is used as the material for the piezoelectric element.

Piezoelectric type ink jet recording heads typically include a plurality of piezoelectric elements and ink chambers. An actuator is provided for controlling ejection of ink from the plurality of ink chambers. A wiring substrate is connected to the actuator in order to transmit drive signals to the actuator.

The various components of the ink jet recording head are not strongly connected together. Also, vaporized ink can contact the actuator, or where the various components are connected together, and degrade electrical characteristics or even cause short circuits. To prevent these problems, a nozzle guide is used to cover the outer peripheral surface of the actuator. An ink jet recording head fitted with the nozzle guide is attached onto a base plate of the carriage. Seal agent, such as a silicone type adhesive, is coated over the space between the nozzle guide and the base plate in order to prevent ink from entering through the space and contacting the actuator and other covered components.

SUMMARY OF THE INVENTION

However, with this conventional configuration, it is difficult to accurately position the cover guide with respect to the actuator when assembling the head. The head can be damaged or improperly assembled because of this. Further, when the actuator and the nozzle guide are being attached together, the nozzle guide can contact the outer ends of the wiring substrate where the wiring substrate is connected to the actuator. As a result, the wiring substrate can peel away from the actuator, so that electrical characteristic of the wiring substrate and continuity of the connection can be degraded. Still further, the space is open between the nozzle guide and the actuator, and there is a danger that ink will enter through the space, until the ink jet recording head is fixed onto the carriage and the seal agent is actually coated over the space. Because ink can enter through the space, it is not possible to supply ink to the actuator or perform ink-ejection tests with the supplied ink until the actuator is fixed in place and coated with seal on the carriage.

It is an objective of the present invention to provide an ink jet recording head that enables easy and proper assembly of the actuator with respect to the nozzle guide, without damaging the actuator portion of the head. It is another objective of the present invention to overcome the above-described problems and provide an ink jet recording head wherein ink can be supplied to the actuator before the actuator is mounted on the carriage, without fear that ink will cling to the actuator or to connection portions between various electrical components.

An ink-jet recording head according to one aspect of the present invention includes an actuator and a nozzle guide. The actuator ejects ink through a plurality of nozzle apertures. The nozzle guide covers an outer periphery of the actuator while exposing the nozzle apertures. The nozzle guide includes a positioning portion used to position nozzle guide with respect to the actuator during assembly.

With this configuration, the ink nozzle guide can be accurately positioned during assembly of the ink jet recording head.

The ink-jet head according to this aspect of the present invention can be manufactured using the following method. First, an actuator for ejecting ink through a plurality of nozzle apertures is prepared. Then a nozzle guide with a frame shape is formed, wherein the nozzle guide has a nozzle side and a positioning-portion side at opposite sides thereof. The nozzle guide is formed with a positioning portion in an edge portion of the positioning-portion side. Then a fixing member is abutted against the positioning portion to press the nozzle side of the nozzle guide against a flat surface while, according to operation of a slanting portion that is provided to at least one of the positioning portion of the nozzle guide and the fixing member, guiding the nozzle guide to a predetermined position. Then the actuator is inserted into the nozzle guide to cover an outer periphery of the actuator with the nozzle guide while exposing the nozzle apertures.

An apparatus for positioning a nozzle guide and an actuator according to this aspect of the present invention includes a flat surface, a fixing member, and an actuator-positioning unit. The fixing member presses against a positioning portion of the nozzle guide to press a nozzle side of the nozzle guide against the flat surface while, according to operation of a slanting portion that is provided to at least one of the positioning portion of the nozzle guide and the fixing member, guiding the nozzle guide to a predetermined position on the flat surface. The actuator-positioning unit positions the actuator in the nozzle guide so that the nozzle guide covers an outer periphery of the actuator while exposing nozzle apertures of the actuator.

According to another aspect of the present invention, an ink jet recording head includes an actuator, a wiring substrate, and a nozzle guide. The actuator ejects ink through a plurality of nozzle apertures. The wiring substrate has a connection portion connected to the actuator. The connection portion has ends that define outer extent of a connection range between the wiring substrate and the actuator. The wiring substrate transmits drive signals to the actuator through the connection portion to drive the actuator to eject ink. The nozzle guide covers the connection portion between the actuator and the wiring substrate. The nozzle guide is configured to be out of physical contact with ends of the connection portion.

With this configuration, the nozzle guide will not contact the wiring substrate while the nozzle guide is being attached to the actuator, so that the wiring substrate will not be snagged and peeled away from the actuator by the nozzle guide. Accordingly, the electrical characteristic of the wiring substrate will not be degraded by damage at its ends. Also, a non-continuous state at the connection portion caused by damage at the ends of the wiring substrate can be prevented.

According to another aspect of the present invention, an ink-jet recording head includes an actuator, a wiring substrate, a nozzle guide, a manifold, and seal agent. The actuator ejects ink through a plurality of nozzle apertures. The wiring substrate is connected to the actuator at a connection portion. The wiring substrate is for transmitting drive signals to the actuator through the connection portion to drive the actuator to eject ink. The nozzle guide covers the connection portion between the actuator and the wiring. substrate. The seal agent fills areas between the actuator and the nozzle guide and between the wiring substrate and the actuator, and also covers the connection portion between the actuator and the wiring substrate.

With this configuration, the seal agent prevents ink from seeping into the connection portion between wiring substrate and the actuator, even if ink is supplied to the actuator before the head is mounted onto a carriage. Moreover, even if the actuator 16 is made from lead zirconate titanate or other material that includes lead, the user can handle the actuator safely because no part of the actuator is exposed to contact by the user.

According to another aspect of the present invention, an ink-jet recording head includes an actuator, a wiring substrate, a nozzle guide, a manifold, and seal agent. The actuator ejects ink through a plurality of nozzle apertures. The wiring substrate is connected to the actuator at a connection portion. The wiring substrate is for transmitting drive signals to the actuator through the connection portion to drive the actuator to eject ink. The nozzle guide covers the connection portion between the actuator and the wiring substrate. The manifold is connected to the actuator and supplies the ink to the actuator. Seal agent fills areas between the nozzle guide and the actuator and between the actuator and the manifold. The seal agent supports the wiring substrate in between the nozzle guide and the manifold and surrounds an entire circumference of an outer peripheral surface of the actuator.

With this configuration, the actuator is completely encompassed by the seal agent between the nozzle guide and the manifold, so that ink will not come in contact with the actuator. Also, the ink-jet recording head is made as an independent head unit, so ink can be supplied to the actuator and ink ejection tests performed.

BRIEF DESCRIPTION OF THE DRAWINGS

The above and other objects, features and advantages of the invention will become more apparent from reading the following description of the embodiment taken in connection with the accompanying drawings in which.

DETAILED DESCRIPTION OF THE EMBODIMENT

Next, an ink jet recording head 11 according to an embodiment of the present invention will be described while referring to the attached drawings. First, an ink jet printer 1 on which the ink jet recording head is mounted will be explained with reference to FIG. 1.

Figure 1:
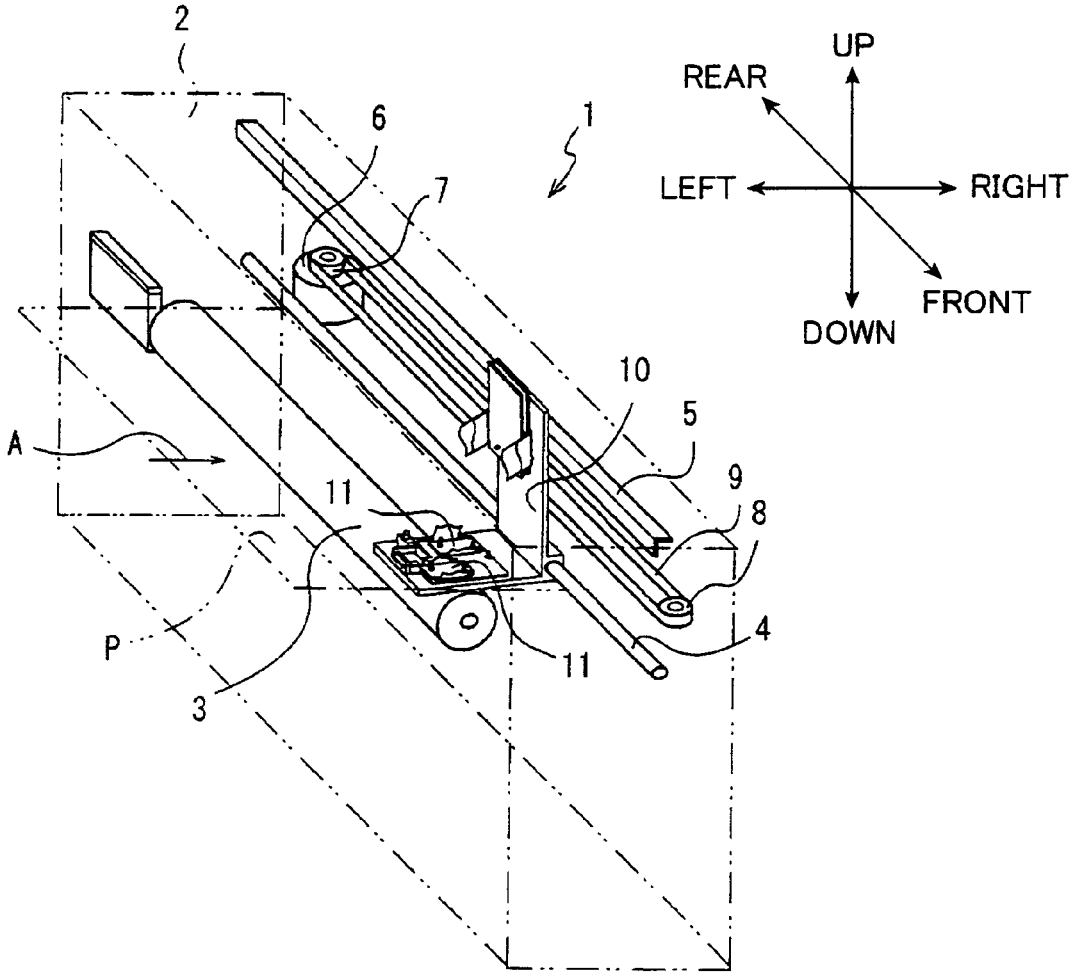
FIG. 1 is a perspective view partially in phantom showing inner configuration of an ink jet printer.

As shown in FIG. 1, the ink jet printer 1 includes a casing 2 and, disposed within the casing 2, a platen roller 3, a carriage 10, a guide rod 4, a guide member 5, pulleys 7 and 8, a belt 9, and a carriage drive motor 6.

The platen roller 3 is rotated by a line-feed motor (not shown) to transport a recording sheet P in the direction indicated by arrow A in FIG. 1. The guide rod 4 and the guide member 5 extend in parallel with the platen roller 3. The carriage 10 is mounted on the guide rod 4 in confrontation with the platen roller 3.

The pulley 7 is fixed to the shaft of a carriage drive motor 6 provided at the left end portion of the casing 2 as viewed in FIG. 1. The pulley 8 is provided at the right end portion at the inside of the casing 2 as viewed in FIG. 1. The belt 9 spans between the pulleys 7 and 8. The carriage 10 is fixed to the belt 9. With this configuration, oscillating drive force from the carriage drive motor 6 moves the carriage back and forth in parallel with the platen roller 3 as guided by the guide rod 4 and the guide member 5.

The ink recording head 11 is mounted on the upper surface of the carriage 10. The ink recording head 11 receives drive signals generated, based on image data, by a circuit board (not shown) and forms images on the surface of the recording sheet P by ejecting ink onto the recording sheet P based on the drive signals.

Next, the ink recording head 11 will be described in more detail with reference to FIGS. 2 through 6. The ink recording head 11 includes an actuator 16, a pair of wiring substrates 17*a*, 17*b*, a pair of manifolds 18, and a nozzle guide 20.

The actuator 16 includes a center plate 12, a pair of actuator substrates 13*a*, 13*b*, and a nozzle plate 15. The center plate 12 is formed in a flat rectangular shape. The actuator substrates 13*a*, 13*b* are attached to either side of the center plate 12 by adhesive, so that the center plate 12 is sandwiched between the actuator substrates 13*a*, 13*b*. The pair of actuator substrates 13*a*, 13*b* are formed from a piezoelectric material made from lead zirconate titanate, commonly known as PZT, to a rectangular shape that is large enough to substantially cover the lower portion of the center plate 12. The surfaces of the actuator substrates 13*a*, 13*b* that face the center plate 12 are formed with ink channels.

Figure 4:
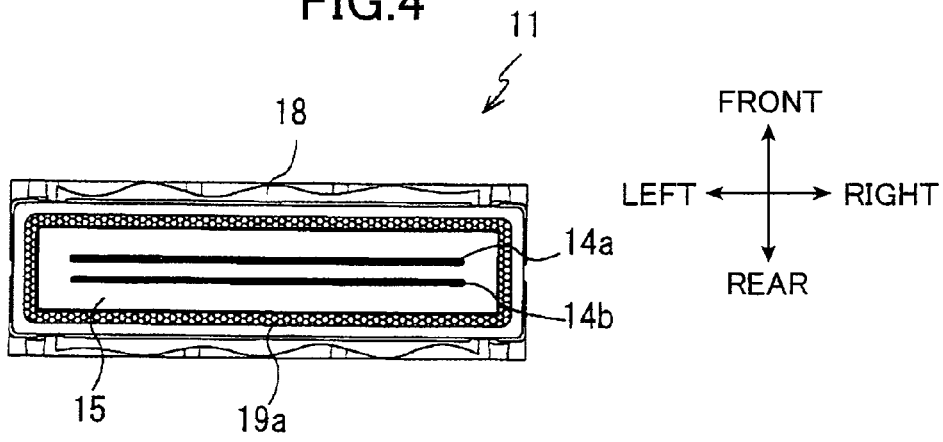
FIG. 4 is a view showing the underside of the ink jet recording head of FIG. 2.
Figure 5:
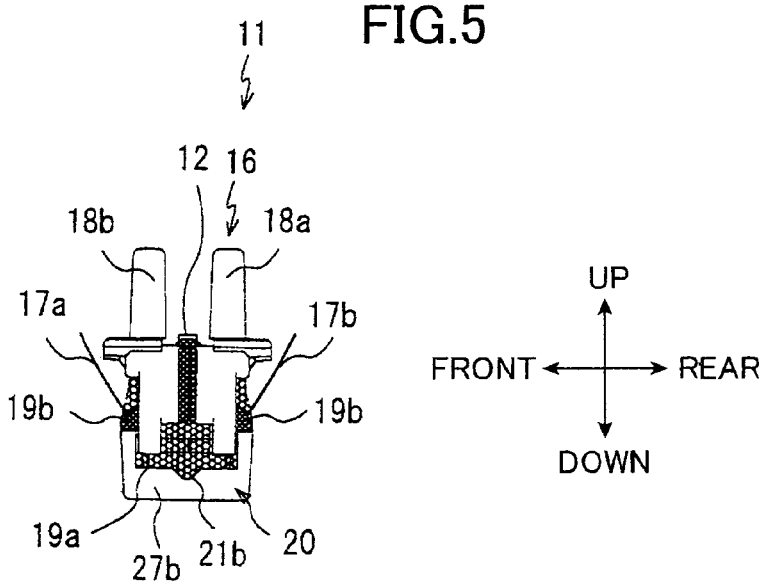
FIG. 5 is a side view showing the ink jet recording head of FIG. 2.

As can be seen in FIG. 4, the nozzle plate 15 has an elongated rectangular shape and is formed with two nozzle rows 14*a*, 14*b* that extend in the lengthwise direction of the nozzle plate 15. The nozzle plate 15 is attached to the lower end, that is, as viewed in FIG. 6, of the connected center plate 12 and actuator substrates 13*a*, 13*b*. An intimate seal with no gaps is developed between the nozzle plate 15 and the actuator substrates 13*a*, 13*b*. The outlet port of each ink channel in the actuator substrates 13*a*, 13*b* is in fluid communication with a corresponding one of the two nozzle rows 14*a*, 14*b* formed in the nozzle plate 15 so that operation of the actuator substrates 13*a*, 13*b* ejects the ink in the ink channels of the actuator substrates 13*a*, 13*b* out through the nozzles of the nozzle rows 14*a*, 14*b*.

Figure 6:
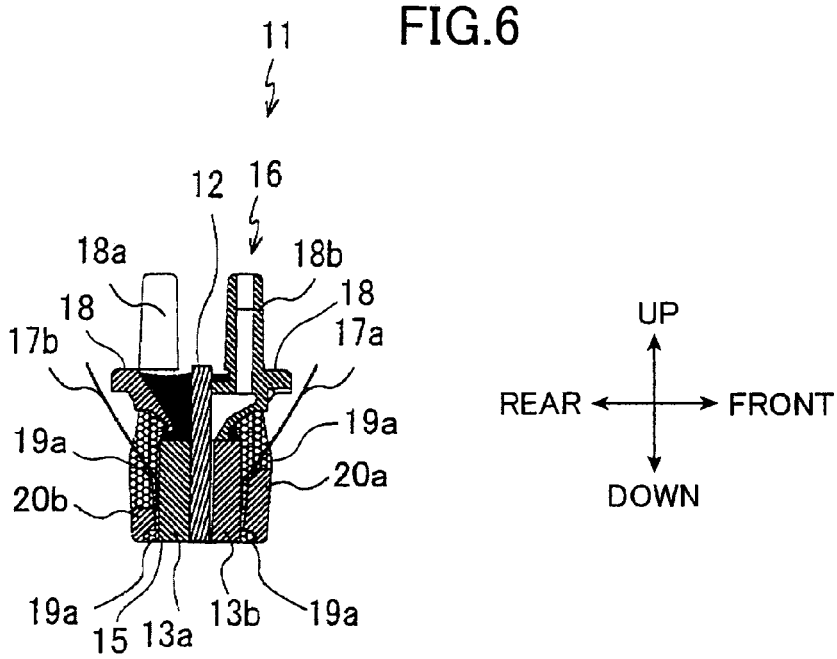
FIG. 6 is a cross-sectional view taken along line VI—VI of FIG. 3.

As can be seen in FIG. 6, the rear-side end of the wiring substrate 17*a* is connected by soldering to the substantial center of the front-side surface of the actuator substrate 13*b*, which is the opposite surface from the surface connected to the center plate 12. The front-side end of the wiring substrate 17*b* is connected by soldering to the substantial center of the rear-side surface the actuator substrate 13*a*, which is the opposite surface from the surf ace connected to the center plate center plate 12. The solder connections between the wiring substrates 17*a*, 17*b* and the actuator substrates 13*a*, 13*b* extend in parallel with the nozzle plate 15. The wiring substrates 17*a*, 17*b* are made from a flexible resin, such as polyimide, into an elongated thin plate that is printed with wiring. Although not shown in the drawings, a circuit board for generating drive signals is connected to the other end of the wiring substrates 17*a*, 17*b*. The wiring substrates 17*a*, 17*b* serve to transmit the drive signals to the actuators 16 so that the actuators 16 can be driven.

Each manifold 18 is connected by adhesive to the upper surface of the corresponding one of the actuator substrates 13*a*, 13*b*, that is, to the surface that is opposite from the surfaces of the actuator substrates 13*a*, 13*b* that are connected to the nozzle plate 15. The manifolds 18 supply ink to the ink channels formed in the actuator 16. The manifolds 18 are provided with two ink supply tubes 18*a*, 18*b* connected to the ink channels of the actuator substrates 13*a*, 13*b* so that ink supplied from an external ink supply source to the supply tube 18*a* flows into the ink channel group of the actuator substrate 13*a* and ink supplied to the ink supply tube 18*b* flows into the ink channel group of the actuator substrate 13*b*.

The nozzle guide 20 has a rectangular frame shape. The nozzle guide 20 is attached by seal agent 19*a* and optically-cured adhesive 19*b* to the actuator 16 so as to cover the outer peripheral surface of the actuator 16, with the exception of the end surfaces of the actuator 16 that are connected to the nozzle plate 15 and to the manifolds 18. The seal agent 19*a* is a silicone type adhesive having electrically insulating properties, waterproofing properties, and adhesive properties. The optically-cured adhesive 19*b* is for temporarily fixing the nozzle guide 20 to the actuator 16. The nozzle guide 20 prevents ink vapor, which is formed during ejection of ink from the nozzle rows 14*a*, 14*b*, from contacting the actuator 16 and also prevents the actuator substrates 13*a*, 13*b* and the wiring substrates 17*a*, 17*b* from pulling apart when the connection portion between the actuator substrates 13*a*, 13*b* and the wiring substrates 17*a*, 17*b* is pulled on for some reason. The nozzle guide 20 will be described in further detail later. Although not shown in the drawings, a nozzle protector for protecting the ink recording head 11 is provided on the carriage 10. The nozzle protector is made from a combination of plastic and rubber and has an inner shape that matches the outer shape of the nozzle guide 20. When the ink recording head 11 is mounted in the nozzle protector, the fit between the inside of the nozzle protector and the outside of the nozzle guide will position the ink recording head 11.

Seal agent 19*a* is coated on the portions of the actuator substrates 13*a*, 13*b* in the gap between the nozzle guide 20 and the nozzle plate 15 and in the gap between the nozzle guide 20 and the manifolds 18, on the connection portion between the actuator substrates 13*a*, 13*b* and the wiring substrates 17*a*, 17*b*, and on the portion of both surfaces of each wiring substrate 17*a*, 17*b* near these other coated areas. Optically-cured adhesive 19*b* is coated between the nozzle guide 20 and the actuator 16 to temporarily fix the nozzle guide 20 to the actuator 16. By coating these areas with the seal agent 19*a* and optically-cured adhesive 19*b*, the actuator 16 and the wiring substrates 17*a*, 17*b* can be protected from being contacted by vaporized ink. Accordingly, degradation of electrical characteristics and short circuits caused by ink directly contacting the actuator 16 and the wiring substrates 17*a*, 17*b* can be reliably prevented. It should be noted that the optically-cured adhesive 19*b* itself has no waterproofing properties, so the seal agent 19*a* is coated in the vicinity of the optically-cured adhesive 19*b* in order to prevent ink from penetrating through the optically-cured adhesive 19*b*.

Next, a detailed explanation will be provided for the nozzle guide 20 while referring to FIGS. 7 to 12. The nozzle guide 20 is a rectangular shaped member formed from a resin material. The nozzle guide 20 is attached to the actuator 16 so as to cover the outer peripheral surface of the actuator 16. The nozzle guide 20 includes a frame portion 22, wall portions 20*a*, 20*b*, and protrusion portions 25*a*, 25*b*, 25*c*, 25*d*, all formed integrally together from the resin material.

Figure 9:
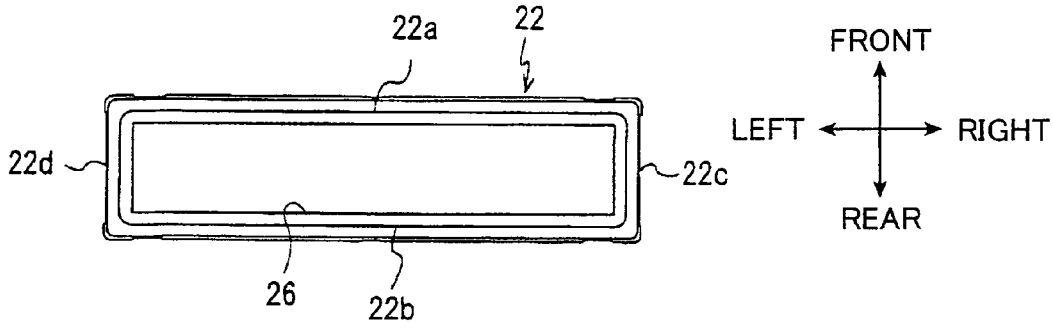
FIG. 9 is a view showing the underside of the nozzle guide of FIG. 7.

As best viewed in FIG. 9, the frame portion 22 has a rectangular frame shape that defines an opening 26 with its inner surface. The frame portion 22 includes two confronting long sides 22*a*, 22*b* and two confronting short sides 22*c*, 22*d*. The two short sides 22*c*, 22*d* are sandwiched between ends of the long sides 22*a*, 22*b*.

Figure 7:
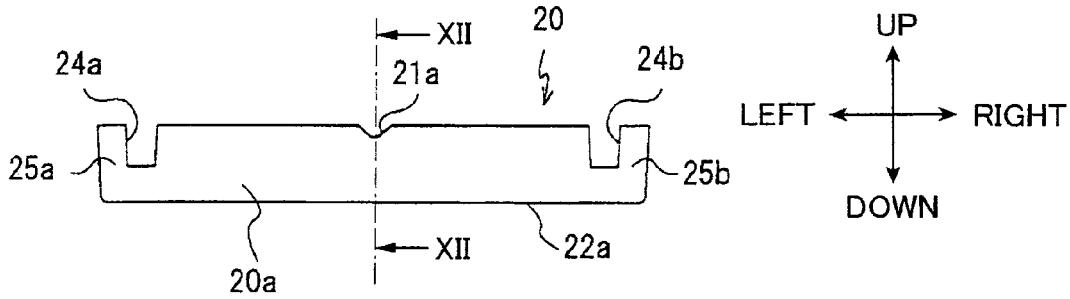
FIG. 7 is a front view showing a nozzle guide of the ink jet recording head of FIG. 2.
Figure 10:
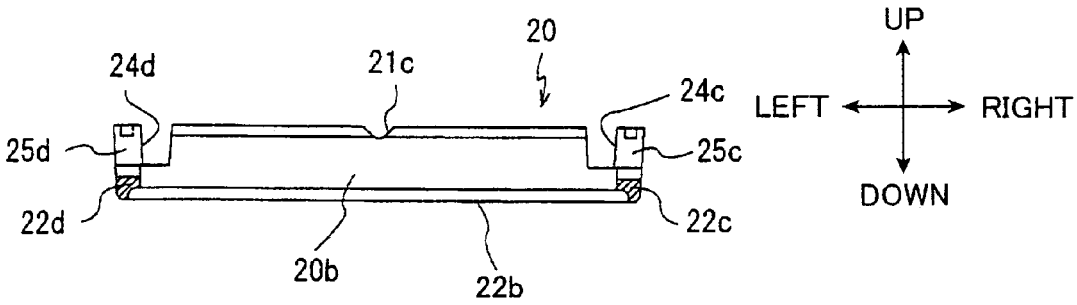
FIG. 10 is a cross-sectional view taken along line X—X of FIG. 8.
Figure 11:
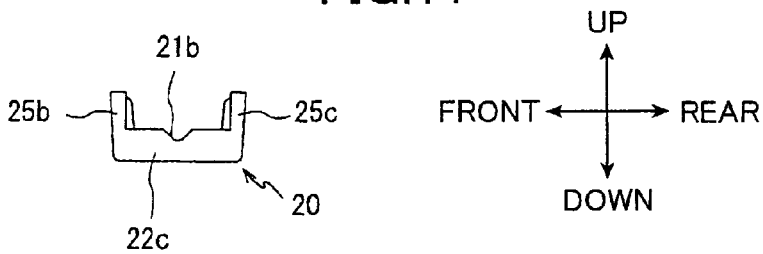
FIG. 11 is a side view showing the nozzle guide of FIG. 7.
Figure 12:
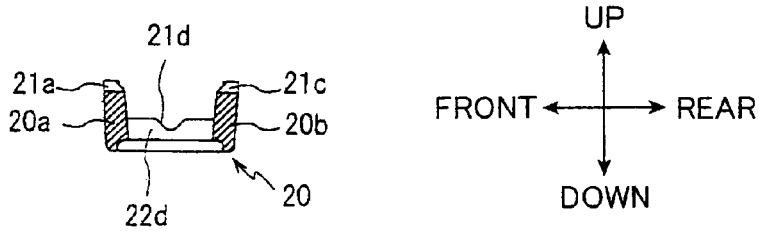
FIG. 12 is a cross-sectional view taken along line XII—XII of FIG. 7.
Figure 13:
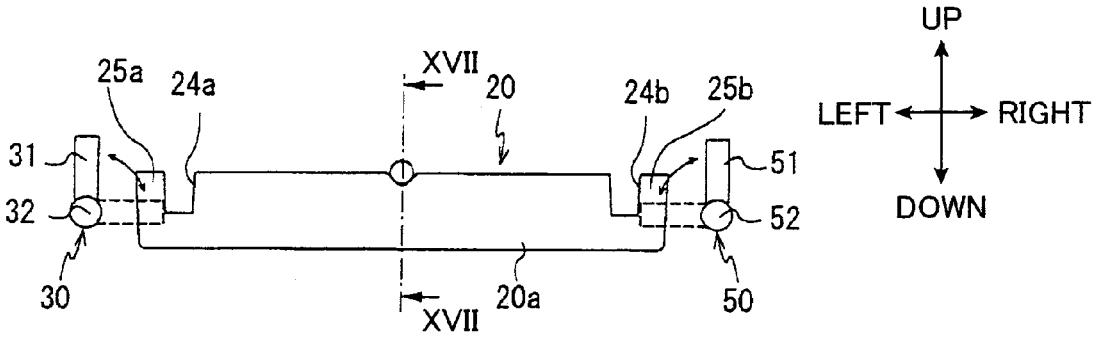
FIG. 13 is a front view showing the nozzle guide being positioned on a work bench.

The wall portions 20*a*, 20*b* are formed integrally with the long sides 22*a*, 22*b*, respectively, of the frame portion 22 in an upright thin plate shape with the same thickness as the corresponding long side 22*a*, 22*b* shown in FIG. 9. The wall portions 20*a*, 20*b* extend upward from the long sides 22*a*, 22*b*, respectively. More specifically, the wall portion 20*a* is formed on top of the long side 22*a* as shown in FIG. 7 and the wall portion 20*b* is formed on top of the long side 22*b* as shown in FIG. 10. Accordingly, as shown in FIGS. 10 and 12, the upper edges of the wall portions 20*a*, 20*b* are higher than the upper edges of the short sides 22*c*, 22*d* of the frame portion 22.

Figure 8:
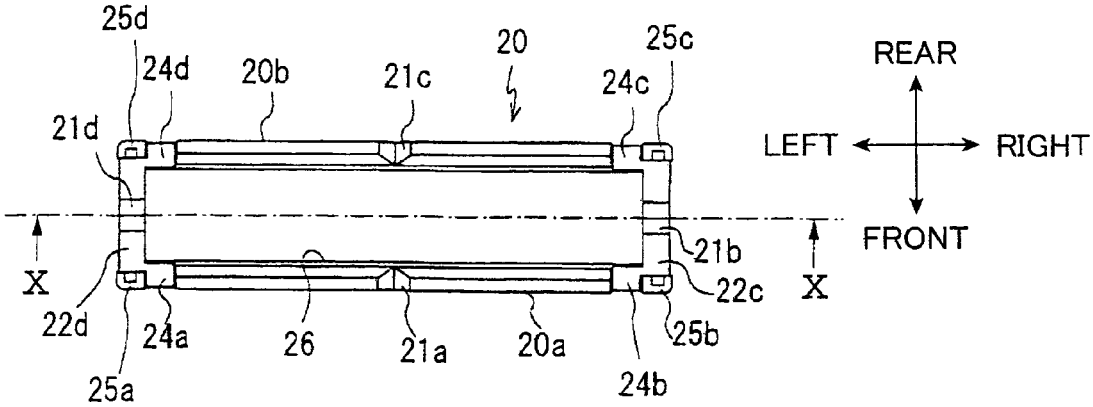
FIG. 8 is a plan view showing the nozzle guide of FIG. 7.

As best seen in FIG. 8, V-shaped grooves 21*a*, 21*c*, 21*b*, 21*d* are formed in the upper center of the wall portions 20*a*, 20*b* and the short sides 22*c*, 22*d*, respectively. As will be described later, the V-shaped grooves 21*a*, 21*c*, 21*b*, 21*d* function to engage with corresponding ones of four fixing members 30, 40, 50, 60 (to be described later) in order to position the nozzle guide 20 to a predetermined position on the upper surface of a work bench (not shown). The V-shaped grooves 21*a*, 21*c*, 21*b*, 21*d* are formed in the center of the upper edges of the wall portions 20*a*, 20*b* and the short sides 22*c*, 22*d* of the frame portion 22. Said differently, the V-shaped grooves 21*a*, 21*c*, 21*b*, 21*d* are formed in the edges of the nozzle guide 20 that are adjacent to the nozzle rows 14*a*, 14*b* after the actuator 16 is inserted into the nozzle guide 20. Described in more detail, the V-shaped groove 21*a* is formed in the wall portion 20*a*, the V-shaped groove 21*c* is formed in the wall portion 20*b*, the V-shaped groove 21*b* is formed in the short side 22*c*, and the V-shaped groove 21*d* is formed in the short side 22*d*. As can be seen in FIGS. 7, 10, 11, and 12, each of the V-shaped grooves 21*a*, 21*c*, 21*b*, 21*d* has a V shape formed from two slanted side walls sandwiching a lower-most portion of the groove. The slanted sidewalls serve as guide portions for guiding the lower-most portion of a corresponding one of the fixing members 30, 40, 50, 60.

As shown in FIG. 8, the protrusion portions 25*a*, 25*b*, 25*c*, 25*d* are formed one at each corner of the frame portion 22. As can be seen in FIGS. 7 and 10, the protrusion portions 25*a*, 25*b*, 25*c*, 25*d* protrude upward from the same side of the four corners of the frame portion 22 as the wall portions 20*a*, 20*b* to substantially the same height as the wall portions 20*a*, 20*b*. Described in more detail, the protrusion portion 25*a* is disposed with an upright posture at the corner between the wall portion 20*a* and the short side 22*d*, the protrusion portion 25*b* is disposed with an upright posture at the corner between the wall portion 20*a* and the short side 22*c*, the protrusion portion 25*c* is disposed with an upright posture at the corner between the wall portion 20*b* and the short side 22*c*, and the protrusion portion 25*d* is disposed with an upright posture at the corner between the wall portion 20*b* and the short side 22*d*.

Notches 24*a*, 24*b*, 24*c*, 24*d* are defined in between the wall portions 20*a*, 20*b* and the protrusion portions 25*a*, 25*b*, 25*c*, 25*d*. The notches 24*a*, 24*b*, 24*c*, 24*d* each have a substantial angled C shape with the upper portion open as viewed in FIGS. 7 and 10. As can be seen in FIG. 8, one of the notches 24*a*, 24*b*, 24*c*, 24*d* is formed near either lengthwise end of each of the long sides 22*a*, 22*b* at positions in between the protrusion portions 25*a*, 25*b*, 25*c*, 25*d* and the wall portions 20*a*, 20*b*. Described in more detail, the notch 24*a* is formed between the wall portion 20*a* and the protrusion portion 25*a*, the notch 24*b* is formed between the wall portion 20*a* and the protrusion portion 25*b*, the notch 24*c* is formed between the wall portion 20*b* and the protrusion portion 25*c*, and the notch 24*d* is formed between the wall portion 20*b* and the protrusion portion 25*d*.

Figure 2:
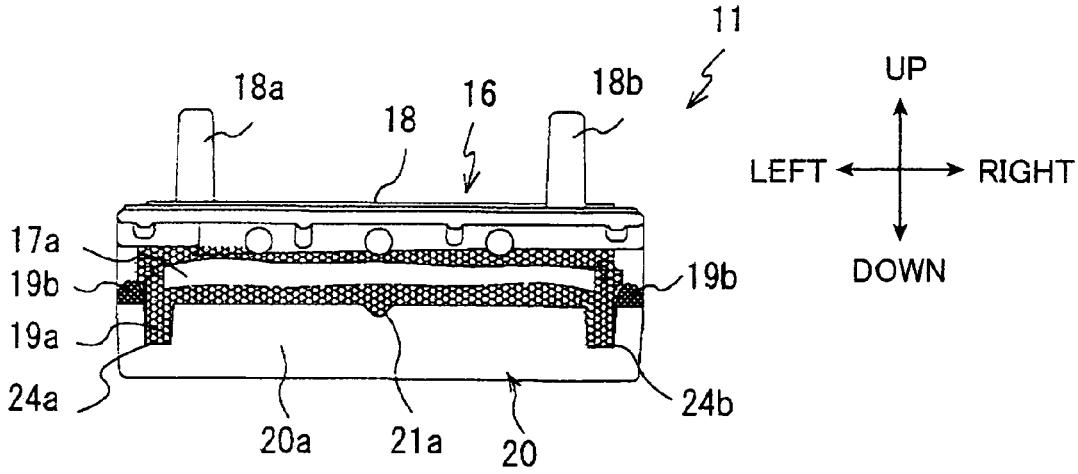
FIG. 2 is a frontal view showing an ink jet recording head used with the ink jet printer of FIG. 1.
Figure 3:
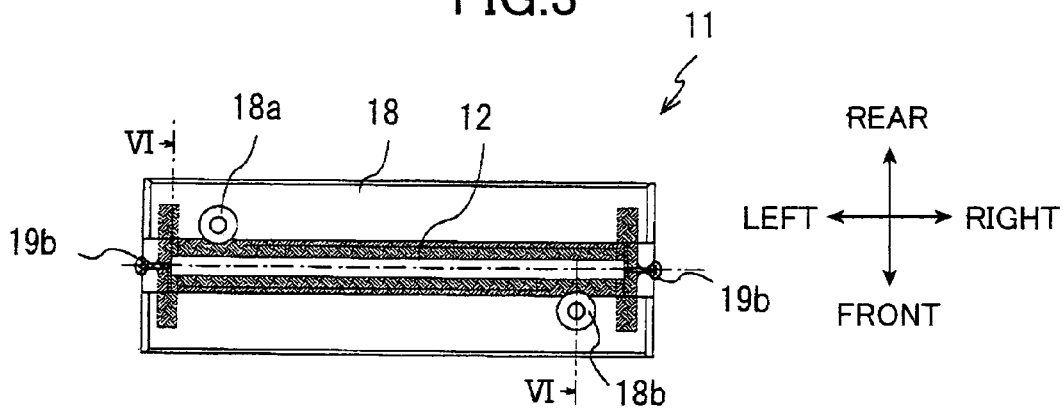
FIG. 3 is a plan view showing the ink jet recording head of FIG. 2.

Notch pairs 24*a*, 24*b* and 24*c*, 24*d* are adjacent to each other with respect to the lengthwise direction of the frame portion 22, that is, the left and right direction as shown in FIG. 8. The lengthwise-direction adjacent notch pairs 24*a*, 24*b* and 24*c*, 24*d* are formed so that the distance between the inside edges, that is, the edges defined by the wall portions 20*a*, 20*b*, is shorter than the width of the wiring substrates 17*a*, 17*b*, but so that the distance between outside edges, that is, the edges defined by the protrusion portions 25*a*, 25*b*, 25*c*, 25*d*, is longer than the width of the wiring substrates 17*a*, 17*b*. Said differently, and as can be seen in FIG. 2, the wiring substrates 17*a*, 17*b* are each formed with a width in the left-right direction that is greater than the distance between the inside edges, but shorter than the distance between outside edges, of lengthwise-direction adjacent notch pairs 24*a*, 24*b* and 24*c*, 24*d*. As a result, the left and right edges of the connection portion where the actuator substrates 13*a*, 13*b* and the wiring substrates 17*a*, 17*b* connect to each other will confront the notches 24*a*, 24*b*, 24*c*, 24*d* as the nozzle guide 20 is being attached to the actuator 16. Further, the outer left and right edges of the wall portions 20*a*, 20*b* that define one inner side of the notches 24*a*, 24*b*, 24*c*, 24*d* taper inward so that the notches 24*a*, 24*b*, 24*c*, 24*d* broaden with proximity to the upper edge of the wall portions 20*a*, 20*b*.

With this configuration, the nozzle guide 20 will not contact the wiring substrates 17*a*, 17*b* while the nozzle guide 20 is being attached to the actuator 16, so that the wiring substrates 17*a*, 17*b* will not be snagged and peeled away from the actuator 16 by the nozzle guide 20. Further, because this is accomplished by notches in the nozzle guide 20, there is no need to create nozzle guide with a new shape. Instead, notches can merely be provided in a conventional nozzle cover so that the nozzle cover is easy to form. Because the edges of the notches have a tapering shape, there is little fear of damaging the wiring substrates even if the wiring substrates are erroneously contacted by the edge of the notch.

Figure 14:
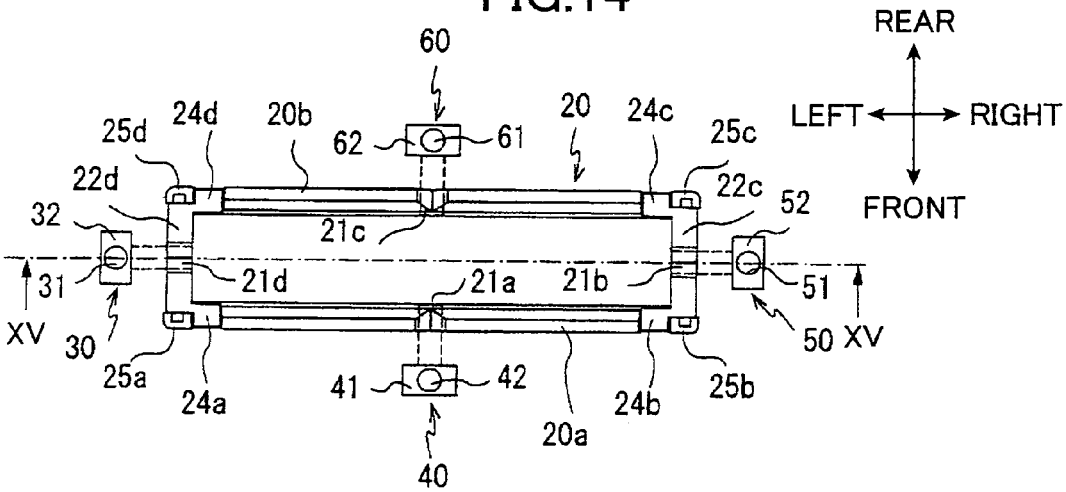
FIG. 14 is a plan view of the situation in FIG. 13.
Figure 15:
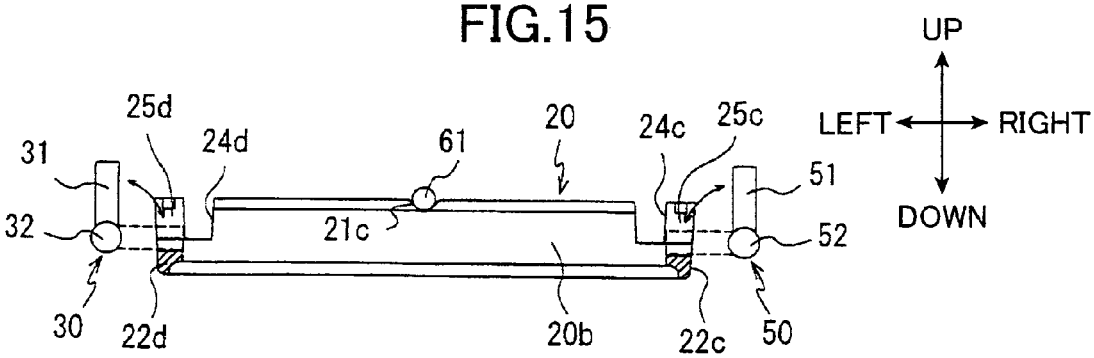
FIG. 15 is a cross-sectional view taken along line XV—XV of FIG. 14.
Figure 16:
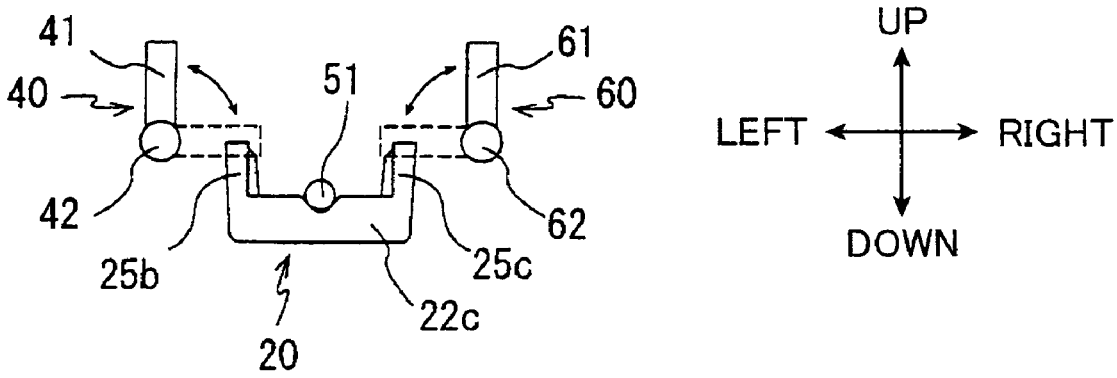
FIG. 16 is a side view of the situation in FIG. 13.
Figure 17:
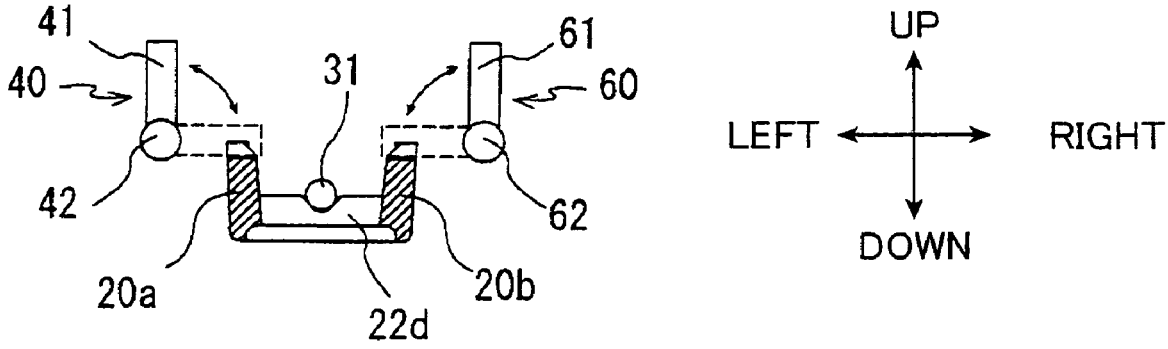
FIG. 17 is a cross-sectional view taken along line XVII—XVII of FIG. 13.

Next, the method of attaching the actuator 16 and the nozzle guide 20 together will be explained while referring to FIGS. 13 to 20. Before attempting to attach the actuator 16 and the nozzle guide 20 together, there is a need to position the nozzle guide 20 in a predetermined position. FIGS. 13 to 17 show the method of positioning the nozzle guide 20 on a work surface, such as a work bench The fixing members 30, 40, 50, 60 for positioning the nozzle guide 20 in a predetermined position are provided on a flat surface of a work bench (not shown). As shown in FIG. 14, the fixing members 30, 40,.50, 60 are disposed a little to the outside from the outer periphery of the frame portion 22 of the nozzle guide 20 to be positioned, each at a position in confrontation with a corresponding one of the V-shaped grooves 21*a*, 21*c*, 21*b*, 21*d*, which are formed in the substantial centers of the edges of the nozzle guide 20. The fixing members 30, 40, 50, 60 include engagement portions 31, 41, 51, 61, respectively, pivot shafts 32, 42, 52, 62, respectively, and also bearings (not shown). More specifically, the fixing member 30 includes the engagement portion 31 and the pivot shaft 32, the fixing member 40 includes the engagement portion 41 and the pivot shaft 42, the fixing member 50 includes the engagement portion 51 and the pivot shaft 52, and the fixing member 60 includes the engagement portion 61 and the pivot shaft 62. The engagement portions 31, 41, 51, 61 are made from metal columnar rods. The pivot shafts 32, 42, 52, 62 each support one end of a corresponding one of the engagement portions 31, 41, 51, 61 to enable the corresponding engagement portions 31, 41, 51, 61 to pivot up and down.

As shown in FIG. 14, the nozzle guide 20 is positioned between the fixing members 30, 40, 50, 60, oriented with the wall portions 20*a*, 20*b* upward. Then, the engagement portions 31, 41, 51, 61 are pivoted from the positions indicated by solid line in FIGS. 13 to 17 downward, that is, toward the V-shaped grooves 21*a*, 21*c*, 21*b*, 21*d* of the nozzle guide 20 so that the engagement portions 31, 41, 51, 61 engage in the V-shaped grooves 21*a*, 21*c*, 21*b*, 21*d* as indicated by broken line FIGS. 13 to 17. The positions of the fixing members 30, 40, 50, 60 and the length of the engagement portions 31, 41, 51, 61 are set so that the engagement portions 31, 41, 51, 61 do not protrude out from the V-shaped grooves 21*a*, 21*c*, 21*b*, 21*d* into the opening 26 of the frame portion 22. After the engagement portions 31, 41, 51, 61 engage in the V-shaped grooves 21*a*, 21*c*, 21*b*, 21*d*, the engagement portions 31, 41, 51, 61 are further pivoted downward so that the engagement portions 31, 41, 51, 61 press against the slanted walls of the V-shaped grooves 21*a*, 21*c*, 21*b*, 21*d*. At this time, the nozzle guide 20 moves, or adjusts its position, in response to the pressure against the slanted walls of the V-shaped grooves 21*a*, 21*c*, 21*b*, 21*d*. The engagement portions 31, 41, 51, 61 press against the slanted walls of the V-shaped grooves 21*a*, 21*c*, 21*b*, 21*d* until the engagement portions 31, 41, 51, 61 engage the lower portion of the V-shaped grooves 21*a*, 21*c*, 21*b*, 21*d*, whereupon the position of the nozzle guide 20 is fixed in place with the nozzle guide 20 pressed against the flat surface of the work bench.

Figure 18:
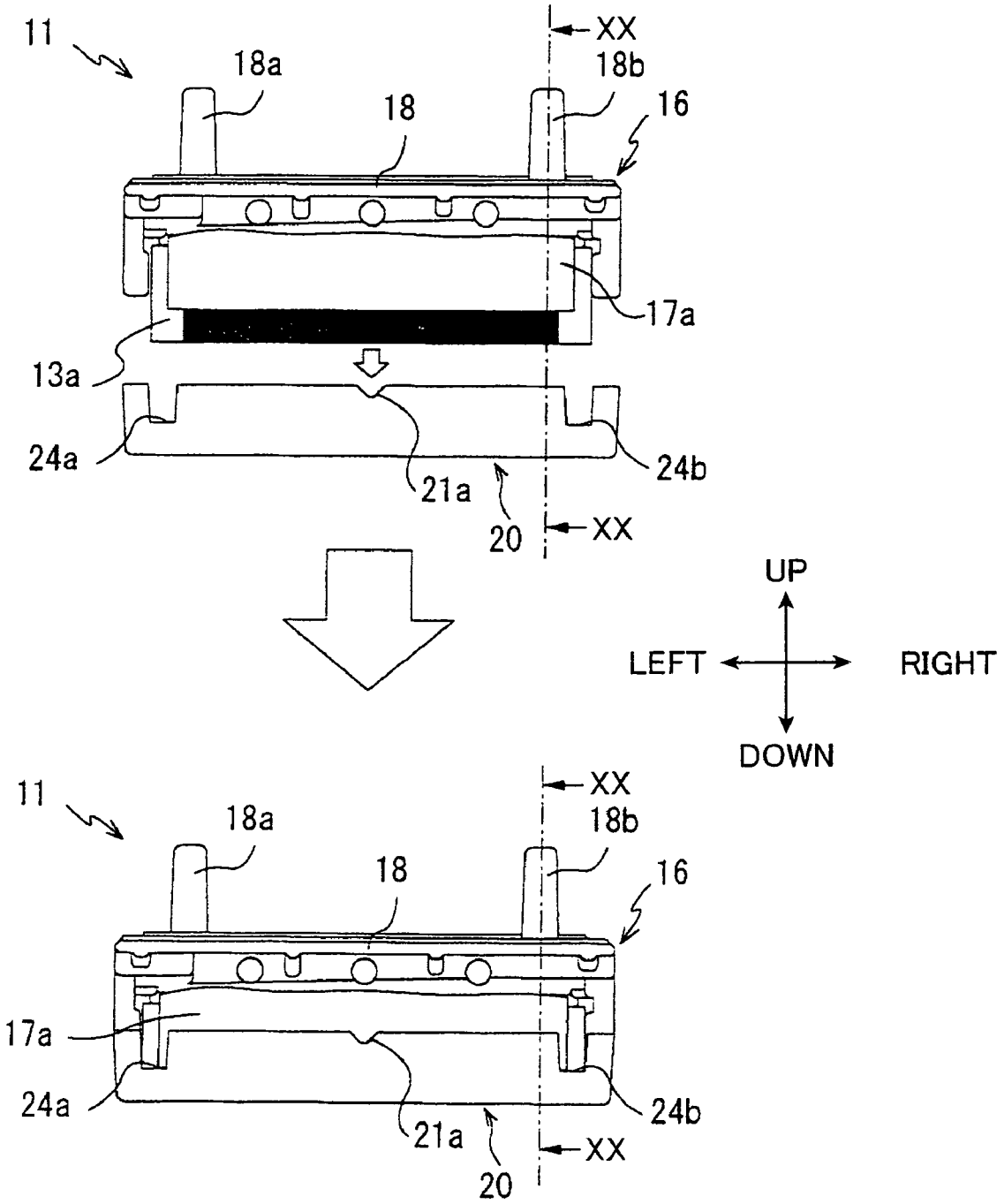
FIG. 18 is a front view showing the condition of the actuator and nozzle guide before and after the nozzle guide is attached to the actuator.
Figure 19:
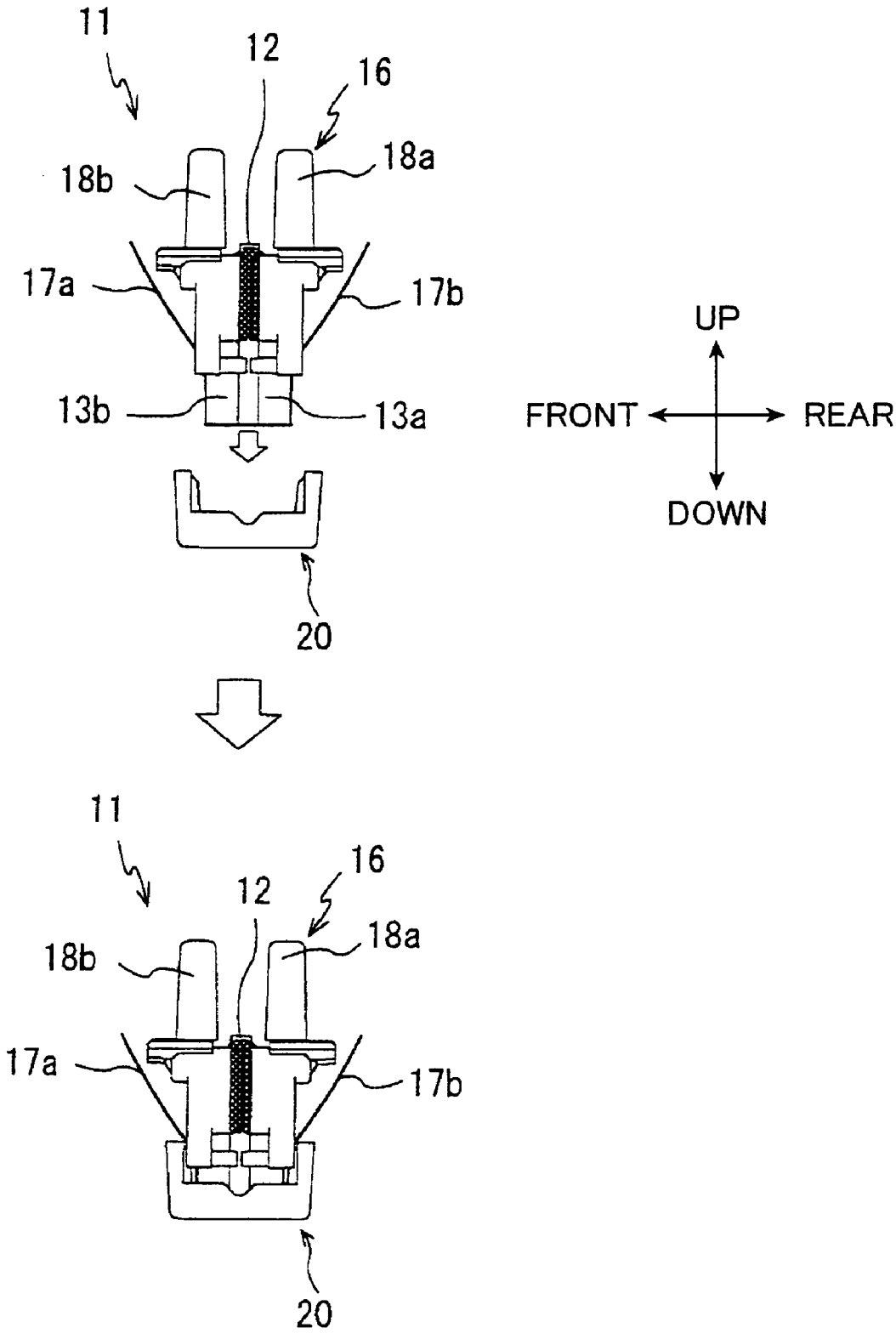
FIG. 19 is a side view of the condition shown in FIG. 18.
Figure 20:
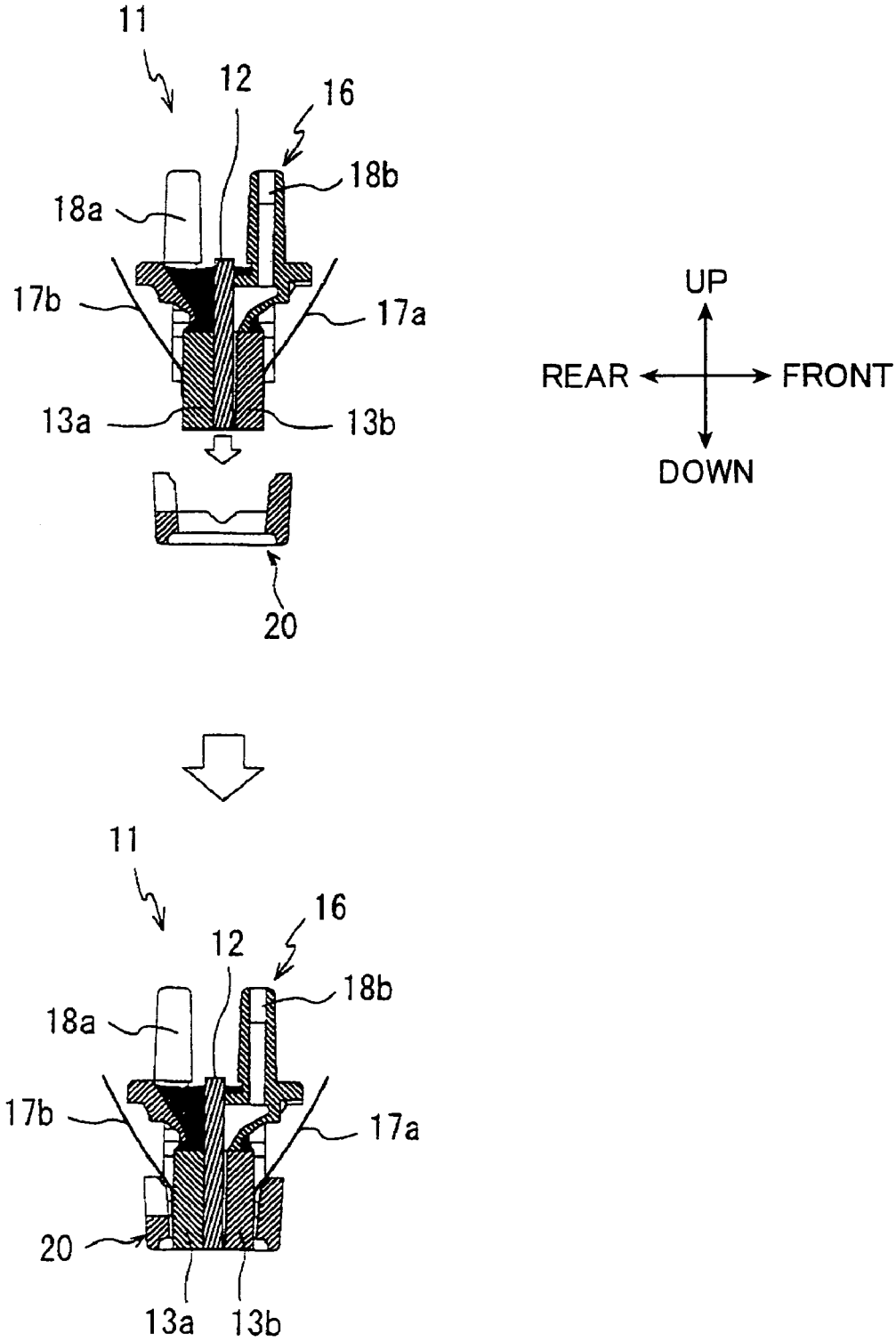
FIG. 20 is a cross-sectional view taken along lines XX—XX of FIG. 18.

After the nozzle guide 20 is pressed against the flat surface of the work bench and fixed in place at the predetermined position, then as shown in FIGS. 18 to 20 the actuator 16 is inserted into the opening 26 of the nozzle guide 20 from above, that is, from the side of the nozzle guide 20 formed with the V-shaped grooves 21*a*, 21*c*, 21*b*, 21*d*. It should be noted that the actuator 16 can be inserted into the nozzle guide 20 either manually or using a vertical-position positioning unit. The vertical-position positioning unit includes a fixing member to which the actuator 16 can be fixed and also a mechanism for moving the fixing member, and consequently the actuator 16, toward or away from the nozzle guide 20, to enable vertically positioning the actuator 16 with respect to the nozzle guide 20.

Figure 21:
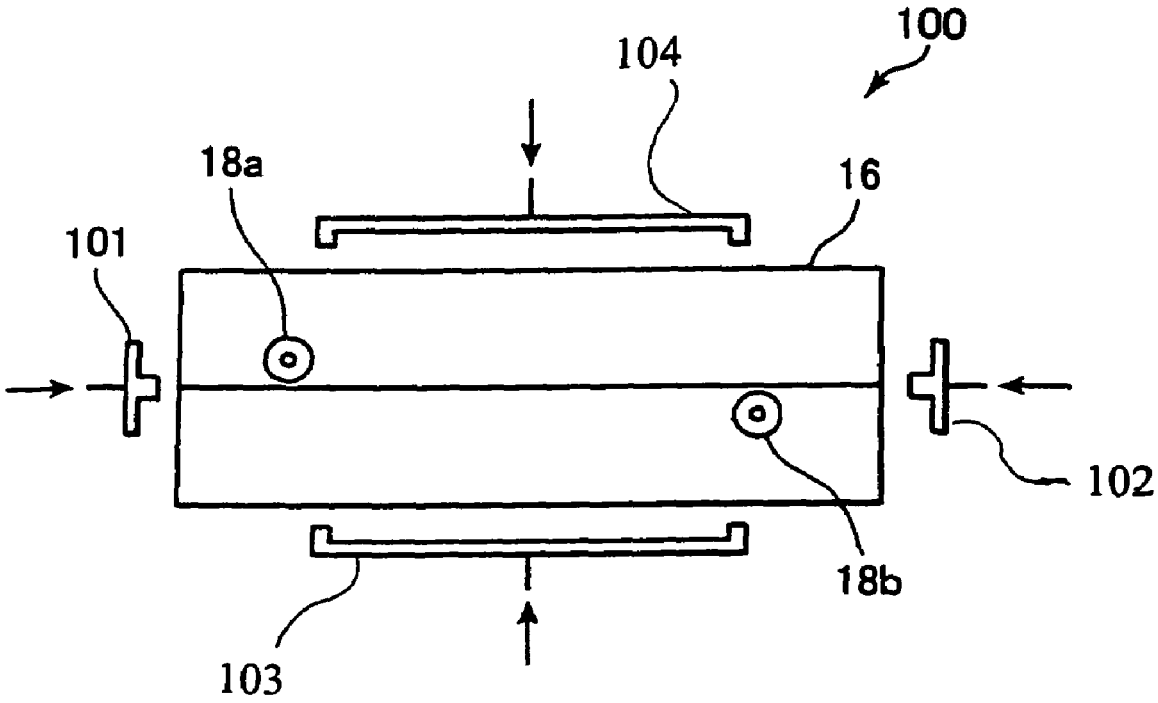
FIG. 21 is a plan view showing an actuator-positioning unit for positioning the actuator in the nozzle guide.

Once the actuator 16 is inserted into the nozzle guide 20, then as shown in FIG. 21, an actuator-positioning unit 100 including pressing members 101, 102, 103, and 104 then adjusts the position of the actuator 16 in the X and Y directions (left-right and front-rear directions), so that the actuator 16 is accurately positioned at a predetermined position in the nozzle guide 20. Once the position of the actuator 16 is set properly, the actuator 16 is pressed into the nozzle guide 20 using a tool (not shown). Then, the optically-cured adhesive 19*b* is coated on and around the portion of the actuator 16 that is in the gap between the protrusion portions 25*a*, 25*b*, 25*c*, 25*d* of the nozzle guide 20 and the manifolds 18, in order to temporarily fix the nozzle guide 20 to the actuator 16 during assembly. Also at this time, seal agent 19*a* is coated between the actuator substrates 13*a*, 13*b* and the wiring substrates 17*a*, 17*b*, between the nozzle guide 20 and the area nearby that portion of the wiring substrates 17*a*, 17*b*, and between short sides 22*c*, 22*d* of the nozzle guide 20 and the actuator 16.

After the nozzle guide 20 and the actuator 16 are connected together and temporarily fixed together by the optically-cured adhesive 19*b*, the engagement portions 31, 41, 51, 61 are removed from the V-shaped grooves 21*a*, 21*c*, 21*b*, 21*d*. Then the ink recording head 11 is removed from the work bench and, as shown in FIGS. 2, 4, and 6, the seal agent 19*a* is coated on the actuator 16 at the gaps in between the nozzle guide 20 and the nozzle plate 15 and the gaps between the wall portions 20*a*, 20*b* of the nozzle guide 20 and the manifolds 18. As a result, the seal agent 19*a* will be coated continuously around the outer periphery of the actuator 16, with the exception of the upper and lower portions, so that it will be impossible for ink vapor to contact the actuator 16. The actuator 16 is covered by the manifolds 16, the nozzle guide 20, the seal agent 19*a*, and the optically-cured adhesive 19*b*, thereby completing a single head unit.

The actuator 16 of the completed head unit is in a completely sealed condition, with the exception of the nozzle plate 15, before the completed head unit is fixed onto the carriage through a base plate in the conventional manner. Therefore, the completed head unit can be filled with ink and tested for nozzle clogs and the like before the completed-head unit is fixed onto the carriage. Even if ink is ejected through the nozzles, the ink will not contact the actuator 16. Also, although the nozzle guide 20 confronts the widthwise ends of the connection portion between the wiring substrates 17*a*, 17*b* and the actuator 16, the nozzle guide 20 does not contact the widthwise ends of the wiring substrates 17*a*, 17*b* because the notches 24*a*, 24*b*, 24*c*, 24*d* are located there. The widthwise ends of the connection portion between the wiring substrates 17*a*, 17*b* and the actuator 16 can be considered to define the outer extent of the connection range between the wiring substrates 17*a*, 17*b* and the actuator 16. As an example, FIG. 6 shows how the location of the notch 24*d* prevents physical contact between the nozzle guide 20 and the leftmost end of the wiring substrate 17*b*. With this configuration, the nozzle guide 20 will not snag and peel the wiring substrates 17*a*, 17*b* off while the nozzle guide 20 is being attached to the actuator 16.

As described above, the V-shaped grooves 21*a*, 21*c*, 21*b*, 21*d* are formed in the upper edge of the frame-shaped nozzle guide 20, which is opposite to the lower edge near the nozzle rows 14*a*, 14*b*. The engagement portions 31, 41, 51, 61 are abutted against the V-shaped grooves 21*a*, 21*c*, 21*b*, 21*d* to press the front edge of the nozzle guide 20 against the flat surface of a work bench. The slanted surface of the V-shaped grooves 21*a*, 21*c*, 21*b*, 21*d* guides the nozzle guide 20 to a predetermined position. Then the actuator 16 is inserted into the nozzle guide 20. Because the ink recording head 11 is manufactured in this manner, the nozzle guide 20 can be accurately positioned and the actuator 16 can be easily attached to the nozzle guide 20. Also, the positioning operation of the nozzle guide 20 is easier to perform than other configurations because the V-shaped grooves 21*a*, 21*c*, 21*b*, 21*d* are formed on the upper edges of the nozzle guide 20, which are opposite from the nozzle-side of the nozzle guide 20. Also, the nozzle guide 20 can be easily guided to the predetermined position using only the simple configuration of the V-shaped grooves 21*a*, 21*c*, 21*b*, 21*d*. Positioning can be accurately performed from for directions because the V-shaped grooves 21*a*, 21*c*, 21*b*, 21*d* are formed at the substantial center of each edge of the frame-shaped nozzle guide 20. It should be noted that the slanted surface for guiding the nozzle guide 20 to a predetermined position could be provided to the engagement portions 31, 41, 51, 61, instead of the V-shaped grooves 21*a*, 21*c*, 21*b*, 21*d*.

While the invention has been described in detail with reference to specific embodiments thereof, it would be apparent to those skilled in the art that various changes and modifications may be made therein without departing from the spirit of the invention, the scope of which is defined by the attached claims.

For example, the embodiment described specific examples of positioning members, engaging portions, and guiding portions. However, these are not to be considered limitations to the present invention. Alternative structures can be used as long as component combinations engage properly. Also the number of components can be freely changed.

Described in more detail, although the embodiment describes the nozzle guide 20 as being formed with the notches 24*a*, 24*b*, 24*c*, 24*d* so that the widthwise ends of the connection portion between the wiring substrates 17*a*, 17*b* and the actuator 16 do not contact the nozzle guide 20, any configuration that enables this is suitable. For example, the nozzle guide can be formed with holes or bulging sections that prevent contact between the widthwise ends of the connection portion and the nozzle guide 20. A nozzle guide modified in either of these ways will be more rigid than the nozzle guide 20 formed with the notches 24*a*, 24*b*, 24*c*, 24*d*.

Also, in the embodiment, the nozzle guide 20 is formed from a single frame-shaped member. with this configuration, the burden on the assembler is lessened while he or she takes great care to assemble the actuator and the nozzle guide without damaging the ends of the wiring substrates. However, the nozzle guide could be configured from a plurality of members. Although such a multi-component structure would be difficult in itself to assemble, the operation of inserting the actuator 16 into the nozzle guide 20 can be dispensed with. That is, the nozzle guide 20 can be mounted around the outside of the actuator 16 so that there is no process of moving both edges in the nozzle guide 20. As a result, the nozzle guide 20 is less likely to damage the actuator 16.

Further, the positioning member provided to the nozzle guide 20 need not be the V-shaped grooves 21*a*, 21*c*, 21*b*, 21*d*, but could be any shape that can engage with the engagement portions 31, 41, 51, 61, such as a curved or angled U-shaped groove. Alternatively, the nozzle guide 20 could be provided with a protruding member as a positioning member. The protruding member could be made detachable from the nozzle guide 20. The positioning member need not be provided at the edge of the nozzle guide 20, but could be located on a peripheral surface of the nozzle guide 20 instead.

The fixing members 30, 40, 50, 60 could be replaced with a structure that pinches the positioning member in order to fix the nozzle guide 20 in place, or with a groove having the same configuration as the outer periphery of the nozzle guide 20. Further, the engagement portions 31, 41, 51, 61 need not be a cylindrical rod shape, but could be angled or other configuration instead.

Further, the structure of the nozzle guide 20 that cooperates with the fixing members 30, 40, 50, 60 to guide the nozzle guide 20 to the predetermined position is not limited to the slanted portion of the V-shaped grooves 21*a*, 21*c*, 21*b*, 21*d*, but could be any other suitable structure as well.

What is claimed is:

1. An ink-jet recording head, comprising:

an actuator that ejects ink through a plurality of nozzle apertures; and a nozzle guide with a frame shape that includes a plurality of wall portions that cover an outer periphery of the actuator and an opening portion from which the actuator is inserted, at least one of the wall portions having a nozzle side that exposes the plurality of nozzle apertures and a positioning portion side at opposite sides thereof, wherein the positioning portion side includes a positioning portion configured to engage a fixing member to position the nozzle guide so that the position of the nozzle guide is fixed in place with the nozzle side of the nozzle guide pressed against a surface of a work area during assembly.

2. An ink-jet recording head as claimed in claim 1, wherein the positioning portion is formed in an edge portion of the positioning-portion side of the nozzle guide.

3. An ink-jet recording head as claimed in claim 1, wherein the positioning portion includes a guiding portion that guides the nozzle guide to predetermined position with respect to the fixing member.

4. An ink-jet recording head as claimed in claim 3, wherein the positioning portion includes a substantially V-shaped groove, the guide portion being a slanted portion of the V-shaped groove.

5. An ink-jet recording head as claimed in claim 3, wherein the nozzle guide has a rectangular frame shape, the positioning portion being formed in a substantial central portion of each edge of the nozzle guide.

6. An ink-jet recording head, comprising:

an actuator that ejects ink through a plurality of nozzle apertures;

a wiring substrate having a connection portion connected to the actuator, the connection portion extending in a first direction and having ends, the wiring substrate transmitting drive signals to the actuator through the connection portion to drive the actuator to eject ink; and a nozzle guide including a wall portion opposed to the connection portion and space portions opposed to ends of the connection portion, wherein a length of the wall portion in the first direction is shorter than a length of the connection portion in the first direction.

7. An ink-jet recording head as claimed in claim 1, wherein the nozzle guide includes notches that confront the ends of the connection portion, thereby preventing physical contact between the nozzle guide and the ends of the connection portion.

8. An ink-jet recording head as claimed in claim 7, wherein the notches of the nozzle guide have a tapering shape.

9. An ink-jet recording head as claimed in claim 8, wherein the nozzle guide is a single member having a frame shape.

10. The ink-jet recording head as claimed in claim 6, wherein a distance between outer ends of the space portions in the first direction is longer than the length of the wiring substrate in the first direction.

11. The ink-jet recording head as claimed in claim 6, wherein the nozzle guide comprises a nozzle side that exposes the plurality of nozzle apertures, the wall portion has an inner surface opposed to the wiring substrate, wherein the inner surface is inclined relative to the actuator, the inner surface being gradually inclined away from the actuator as the inner surface is inclined away from the nozzle portion.

12. An ink-jet recording head, comprising:

an actuator that ejects ink through a plurality of nozzle apertures;

a wiring substrate connected to the actuator at a connection portion, the wiring substrate transmitting drive signals to the actuator through the connection portion to drive the actuator to eject ink;

a nozzle guide that covers the connection portion between the actuator and the wiring substrate; and seal agent that fills areas between the actuator and the nozzle guide and between the wiring substrate and the actuator, and that covers the connection portion between the actuator and the wiring substrate.

13. The ink-jet recording head as claimed in claim 12, wherein the seal agent fills areas between the nozzle guide and the actuator so as to surround an entire circumference of an outer peripheral surface of the actuator while maintaining a nozzle surface of the actuator, where the plurality of nozzle apertures are formed, exposed from the nozzle guide.

14. The ink-jet recording head as claimed in claim 12, wherein the seal agent is a silicone type adhesive.

15. The ink-jet recording head as claimed in claim 12, wherein the nozzle guide has a rectangular frame that covers an entire outer periphery of the actuator while exposing the plurality of nozzle apertures.

16. An ink-jet recording head, comprising:

an actuator that ejects ink through a plurality of nozzle apertures;

a wiring substrate connected to the actuator at a connection portion, the wiring substrate transmitting drive signals to the actuator through the connection portion to drive the actuator to eject ink;

a nozzle guide that covers the connection portion between the actuator and the wiring substrate;

a manifold that is connected to the actuator and that supplies the ink to the actuator;

seal agent that fills areas between the nozzle guide and the actuator and between the actuator and the manifold, the seal agent supporting the wiring substrate in between the nozzle guide and the manifold and surrounding an entire circumference of an outer peripheral surface of the actuator.

17. An ink jet head as claimed in claim 16, further comprising a nozzle plate connected to the actuator and formed with the plurality of nozzle apertures, the seal agent filling areas between the nozzle guide and the actuator while maintaining the nozzle plate exposed from the nozzle guide.

* * * * *